US005697728A

United States Patent [19]

Camomilla et al.

[11] Patent Number: 5,697,728

[45] Date of Patent: Dec. 16, 1997

[54] LIGHT GUARDRAIL FOR BRIDGES

[75] Inventors: Gabriele Camomilla; Stefano Bruschi; Mauro Malgarini, all of Rome, Italy

[73] Assignee: Autostrade Concessioni e Costruzioni Autostrade S.p.A., Rome, Italy

[21] Appl. No.: 581,524

[22] PCT Filed: May 24, 1994

[86] PCT No.: PCT/IT94/00068

§ 371 Date: Jan. 17, 1996

§ 102(e) Date: Jan. 17, 1996

[87] PCT Pub. No.: WO95/03453

PCT Pub. Date: Feb. 2, 1995

[30] Foreign Application Priority Data

Jul. 23, 1993 [IT] Italy ..... RM93A0492

[51] Int. Cl.[6] ..... E01F 15/00; E01D 19/10

[52] U.S. Cl. ..... 404/6; 256/13.1

[58] Field of Search ..... 256/1, 13.1, DIG. 6; 404/6, 9

[56] References Cited

U.S. PATENT DOCUMENTS

| | | | |
|---|---|---|---|
| 2,181,703 | 11/1939 | McCracken | 256/13.1 |
| 3,262,240 | 7/1966 | Schuman et al. | 256/13.1 X |
| 3,276,750 | 10/1966 | Ridder | 256/13.1 |
| 4,954,009 | 9/1990 | Kellison | 404/6 |
| 4,989,689 | 2/1991 | Berlin | 256/DIG. 6 X |
| 5,145,278 | 9/1992 | Lohrmann . | |

FOREIGN PATENT DOCUMENTS

| | | | |
|---|---|---|---|
| 0 428 097 | 5/1991 | European Pat. Off. . | |
| 472847 | 3/1992 | European Pat. Off. | 256/13.1 |
| 0 575 705 | 12/1993 | European Pat. Off. . | |

*Primary Examiner*—James Lisehora

*Attorney, Agent, or Firm*—Young & Thompson

[57] ABSTRACT

Light guardrail for bridges formed by a plurality of uprights (1, 2) made of sheet steel and having a box-like shape. The uprights are individually fixed by means of screw anchors (4) to a support (5) made of concrete (Kerbstone of the viaduct or foundation for the lateral edge on an embankment). The uprights (1, 2) are covered by a cover sheet steel (7) formed by a shaped sheet steel having at New Jersey profile, which partially has at form complementary to the profile of the uprights (1, 2). The individual uprights (1, 2) are connected to each other by means of steel pines (26, 27) fixed on the rear side of the uprights.

6 Claims, 7 Drawing Sheets

LIGHT GUARDRAIL FOR BRIDGES

TECHNICAL FIELD

The present invention relates to a guardrail of the so-called New Jersey type, and in particular to such a guardrail, which will be prevalently installed on the lateral overhangs of bridges having a reduced resistance to loads.

BACKGROUND ART

Guardrails of the New-Jersey type, made of concrete and generally obtained from monolithic elements which are 6 metres in length, has been known since several years. These guardrails initially had a weight of about 850 kg/m (kilograms per meter), and this weight was sometimes too great for the lateral overhangs of bridges and also for the lateral beams of bridges. Later on, the weight was reduced by employing lightened concrete (640 kg/m), or by realizing lightening recesses (440 kg/m). In order to further reduce the weight, guardrails entirely made of steel have been used afterwards (linear specific weight: 130–150 kg/m).

The single parts of the guardrail of the New Jersey type are connected to each other, forming a chain, which at every connection point can yield and move backwards towards the outside, as a result of the collision with a motor vehicle.

Furthermore, ductile anchor means connecting the guardrail to the kerbstone, allow the moving backward of a single part or element of the guardrail onto which the collision occurs, and said ductile anchor means will break only after they have absorbed an amount of energy, so that they do not transfer too large stresses to the underlying structure.

DISCLOSURE OF INVENTION

An object of the present invention is to realize a guardrail having a New Jersey profile, providing a controlled and distributed yielding, and which doesn't transfer excessive stresses to the underlying structure, whereby the guardrail because of its reduced weight (130–150 Kg/m), may also be installed on older type bridges which are not able to resist to excessive loads on the lateral overhangs of the bridge and on the lateral beams.

Another object of the present invention is that of realizing a guardrail which can be assembled at the place where it is installed, without the need of transporting monolithic blocks, and of cranes for lifting the blocks of the guardrail, when said blocks have been brought to the place of installation of the guardrail. Adequate acoustic insulation structures may be introduced inside the guard-rail, if desired, in order to increase the deadening effect which is already produced by the guardrail.

Still another object of the present invention, is to provide stiffening and connecting plates fixed by bolts or the like, to the uprights of the barrier, on their rear sides, and also connecting means which allow a variation of the reciprocal distance of the two neighbouring junction uprights, which variation is due to temperature oscillations.

BRIEF DESCRIPTION OF THE DRAWINGS

The invention will now be described by way of example only, making reference to the annexed drawings, which show a particular embodiment thereof. Each figure shows individually.

BEST MODE OF CARRYING OUT THE INVENTION

Figure 1:
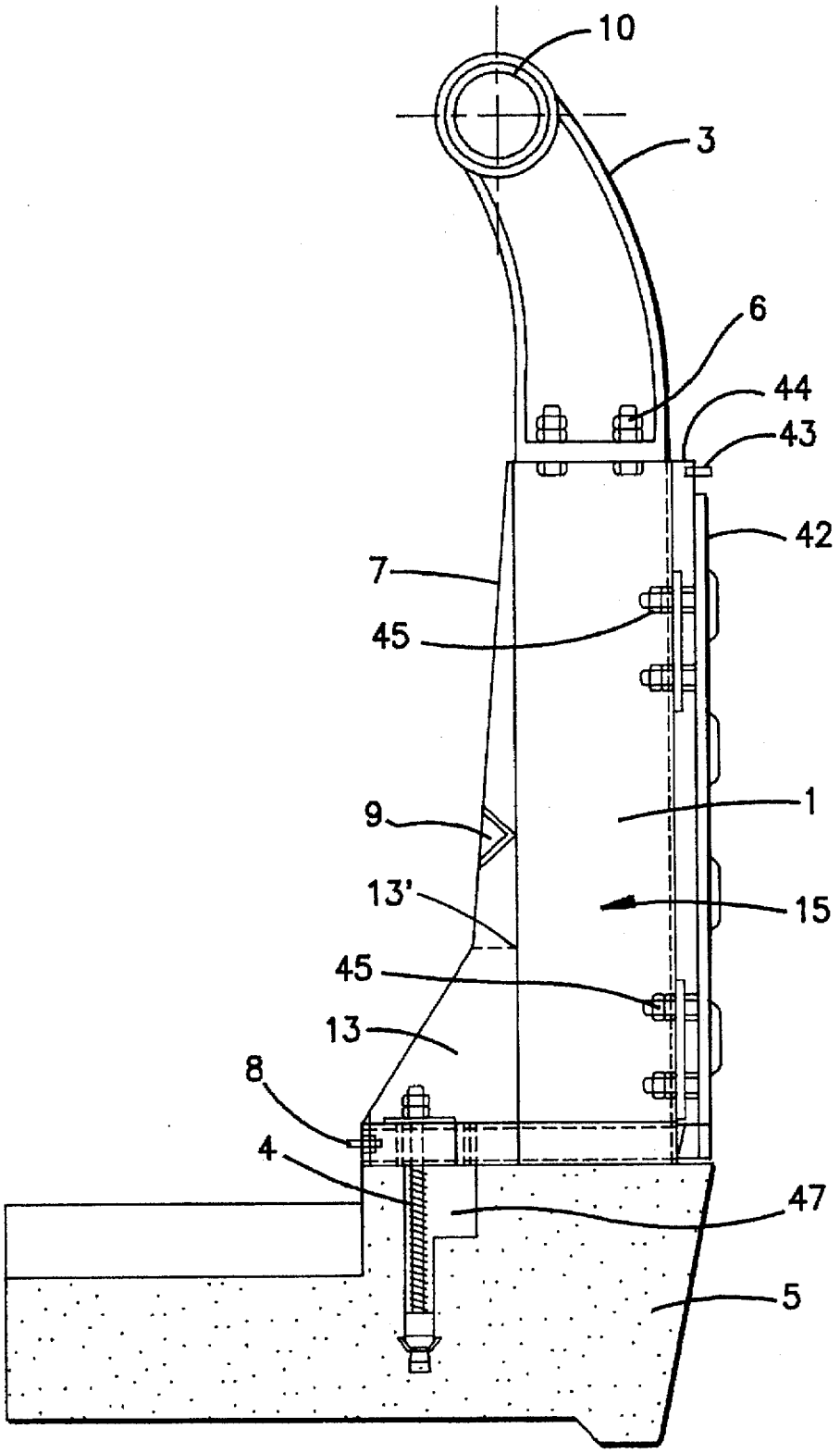
FIG. 1, a transversal cross-sectional view of the New Jersey-guardrail anchored to the kerbstone of the bridge.
Figure 2:
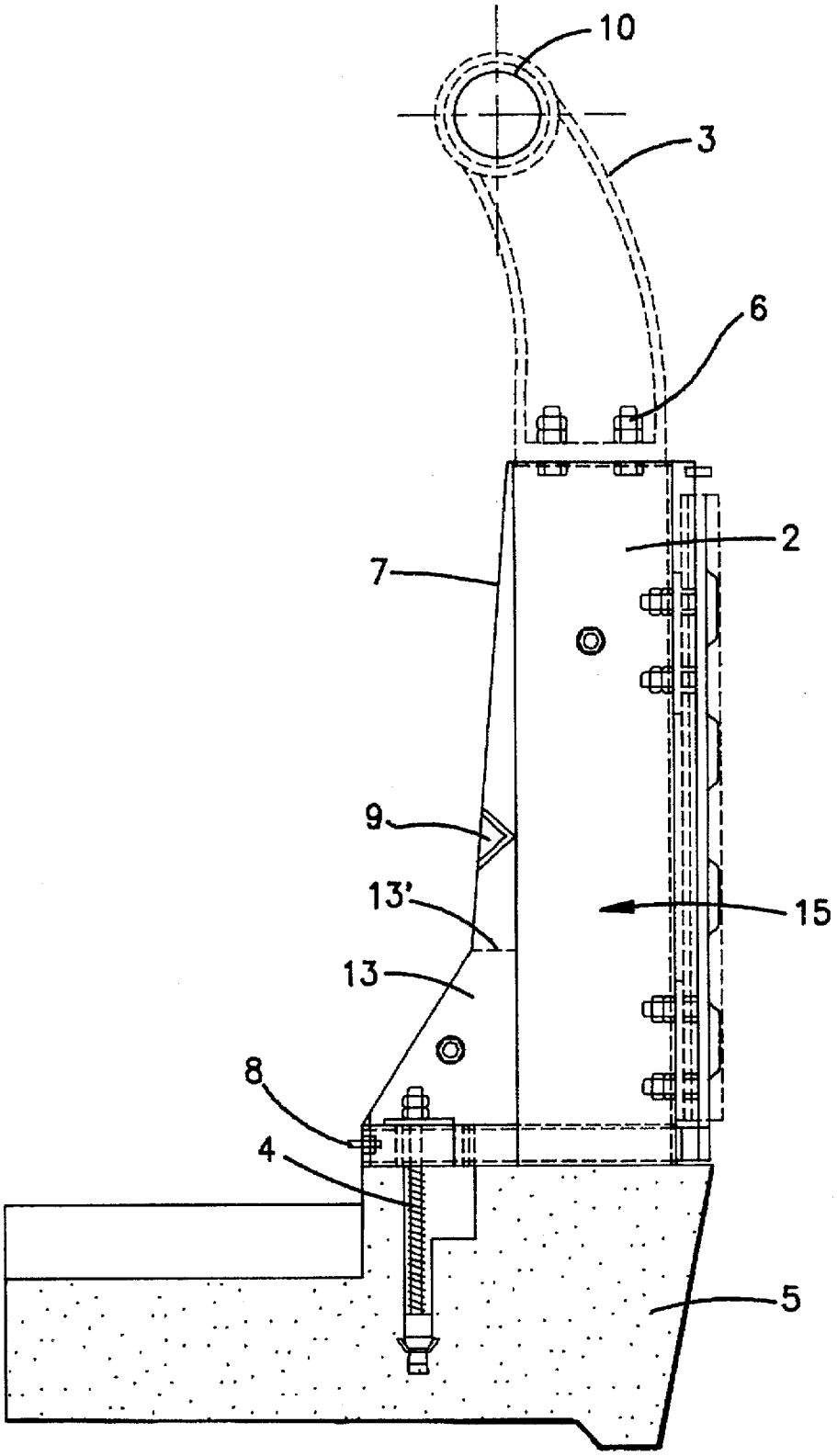
FIG. 2, the New Jersey-guardrail anchored to the kerbstone of the bridge, according to a transversal cross-sectional view, at the junction point between two spans of the bridge.

With reference to the drawings, FIGS. 1 and 2 show the already assembled guardrail according to a sectional view, which is substantially formed by a standard upright 1 or a junction upright 2 to be installed at the junction between two spans of a bridge (the difference between the two uprights will be illustrated in detail in the following description), the guardrail comprising also a post 3 supporting the handrail tube 10 inserted on the upper part of the post 3.

The upright 1 or 2 is fixed to the kerbstone 5 of the bridge, by means of an anchor means 4 (analogous to a dowel for domestic use), whereas the post 3 supporting the handrail is fixed by means of bolts 6 to the upright 1.

Figure 10:
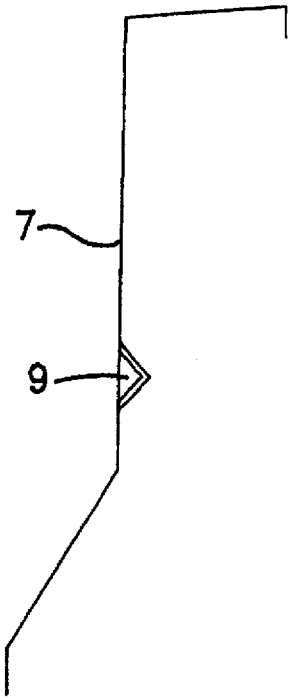
FIG. 10, a cross section of the sheet steel having a New Jersey profile, used for covering the uprights.

A substantial difference with respect to conventional guardrails is that the uprights 1 or 2 are not integral with the cover sheet steel 7 having a New Jersey profile, shown individually in FIG. 10, which has a length of about 6 metres in the present embodiment, but which could have a greater or smaller length corresponding to a submultiple of 1,5 m. Said cover sheet steel (see FIG. 10) will be fixed to the uprights 1 or 2 by means of bolts 6 which are also used, as mentioned above, to fix the post 3 of the handrail to the upright 1.

On its lower part (see FIGS. 1 and 2) the cover sheet steel 7 is fixed to the upright 1 or 2 by means of screw anchors 8. The uprights in the present embodiment are placed about 1.5 metres apart from each other. This New Jersey profile is the same used by the applicant for concrete guardrails installed on the roadnet; as a consequence of several "crash tests", it has been shown that it is adequate to let both heavy vehicles and motor vehicles rebound and simultaneously align themselves again along the road, and moreover it prevents vehicles from overturning.

Therefore, the single parts of the guardrail which formed monolithic parts of about 6 m in length, are now replaced by uprights 1 or 2 which are covered on their front part by the cover sheet steel 7 having a New Jersey profile, whereas on the rear part, said uprights 1 or 2 are connected to each other by means of plates, which allow to two or more contiguous uprights to cooperate on their rear sides, during a collision, so as to limit the deformation of the frontal cover sheet steel 7, this being advantageous for light vehicles; the way in which the plates and the uprights are connected together will be described later.

The guardrail can therefore be assembled at the place of construction (i.e. where the guardrail is used), without the need of particular cranes or other means for lifting very heavy parts.

As can be seen in FIGS. 1 and 2, the cover sheet steel 7 has a reinforcement rib 9.

The method for bolting the cover sheet steel to the uprights is original since it allows to work on the inner side of the bridge without being obliged to use complex equipments and/or stagings for operating from the outside.

Figure 5A:
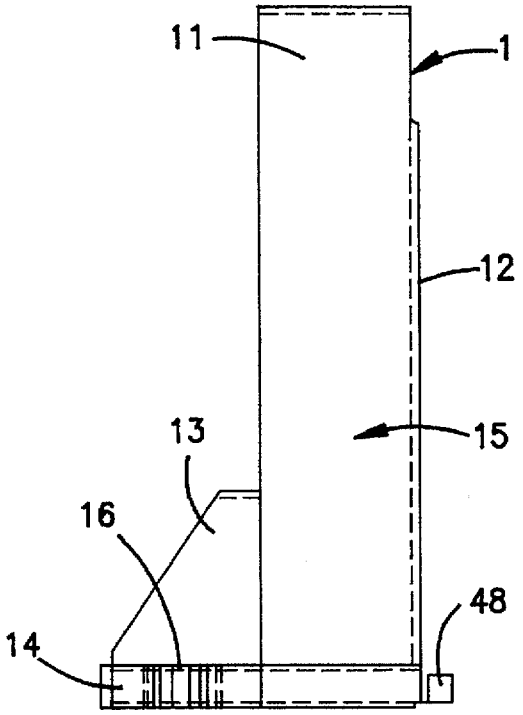
FIG. 5*a*, a lateral view of an upright of the New Jersey guardrail according to the present invention.
Figure 5B:
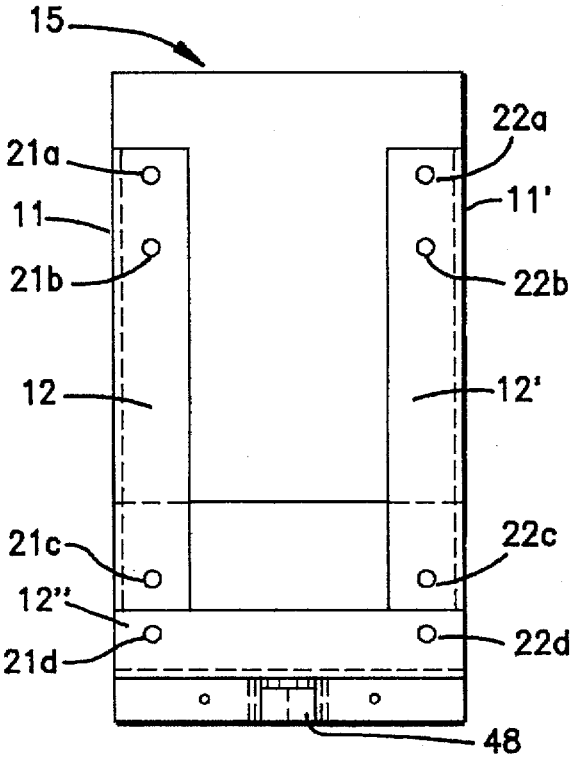
FIG. 5*b*, a rear view of the upright of FIG. 5*a;*

The structure of the "standard" upright 1 is shown in FIGS. 5*a* and 5*b*. It comprises a box-like sheet steel 15, having no base walls, and with two lateral walls having rear rectangular portions 12 and 12', which make up the rear part of the box.

Two trapezoidal walls 13, connected by a plate 13', are welded frontally and laterally (on the two sides) with respect to the box-like sheet steel 15.

Figure 6A:
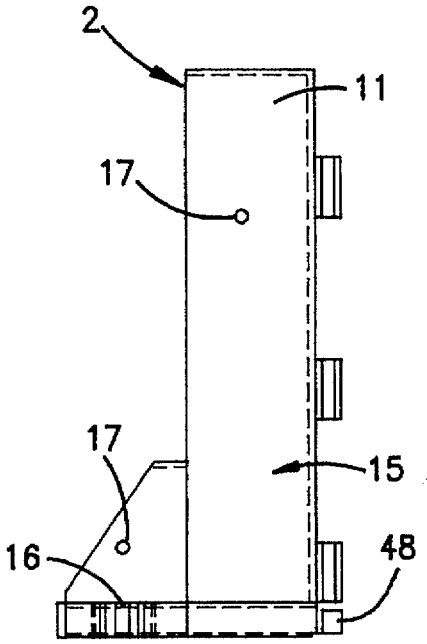
FIG. 6*a*, a lateral view of an upright of the guardrail of the present invention, to be installed at the junction point between two spans.
Figure 6B:
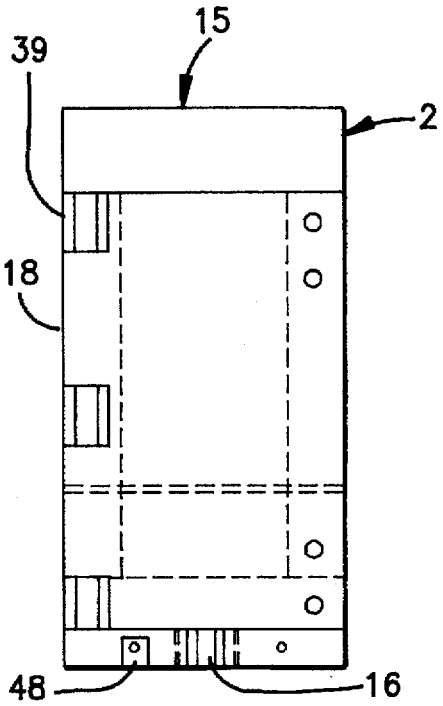
FIG. 6*b*, a rear view of the upright of FIG. 6*a;*
Figure 6C:
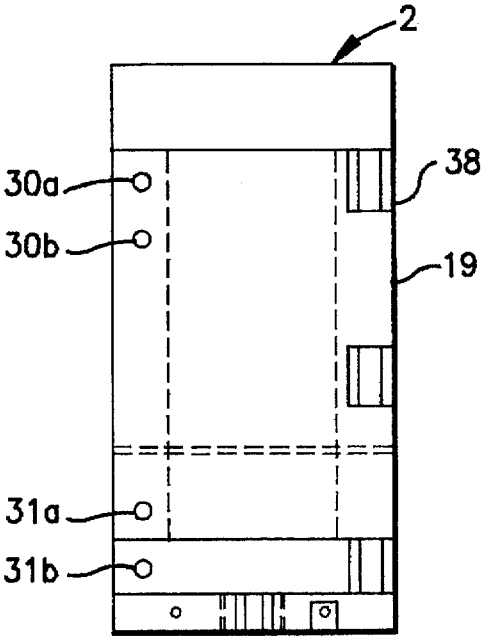
FIG. 6*c*, a rear view of an upright similar to the upright of FIG. 6*b*, and which is installed in a position adjacent to the latter at the junction point between two spans.
Figure 8B:
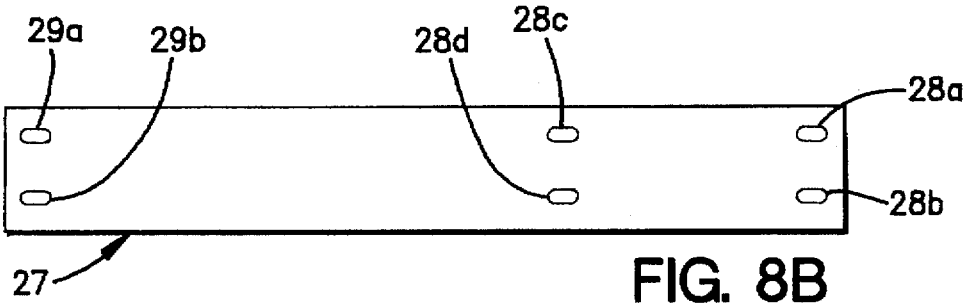
FIG. 8*b*, a connection plate between an upright of FIG. 5*a* or 5*b*, and an upright of FIG. 6*b* or 6*c;*
Figure 9:
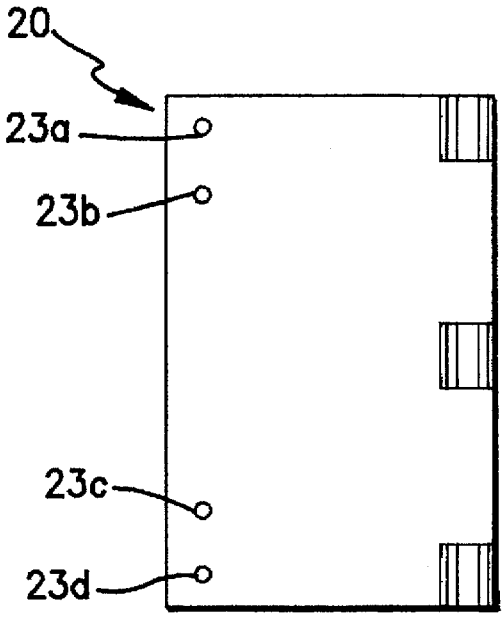
FIG. 9, a plate welded on the rear side of the upright of FIG. 5*b*, in order to obtain the upright of FIG. 6*b* or 6*c* respectively.
Figure 11:
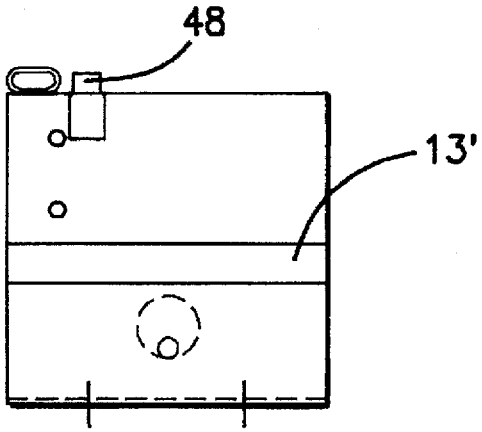
FIG. 11 a plan view of the upright of FIG. 6*c*.

On the lower part, the "standard" upright 1 has a base 14 made by an adequately folded sheet steel welded to the front feet of the box-like sheet steel 15, and on the rear side, to the rectangular portions 12 and 12'; a tube 16 is welded on the bottom wall of the base 14, being aligned with a hole on said bottom wall, the tube being provided for the passage of an anchor means 4 and for absorbing the stresses caused by the tightening of said anchor means (which in a certain sense is similar to a screw anchor for domestic use). The upright of FIGS. 6*a*, 6*b* or 6*c* is substantially the same as the "standard" upright 1, bit it differs from the latter in that;

a) it is provided with lateral holes 17, 17' only on the right side or the left side (in particular, the junction upright 2 shown in FIG. 6*b* has holes 17, 17' on the side indicated by the numeral 18, whereas the junction upright 2 shown in FIG. 6*c*, has such holes 17, 17' on the side indicated by the numeral 19 in FIG. 6*c*);

b) it is obtained from the "standard" upright 1, by welding the plate 20 of FIG. 9, on the rear side of the standard upright 1, onto the rectangular portions 12, 12' and 12". By means of fixing elements which are introduced in the holes 21*a*, 21*b*, 21*c*, 21*d* or in the holes 22*a*, 22*b*, 22*c*, 22*d* and corresponding holes 23*a*, 23*b*, 23*c*, 23*d* which are obtained on the plate 20, plates 27 of FIG. 8*b* will be mounted.

In particular, the holes 23*a*, 23*b*, 23*c*, 23*d* are aligned with the holes 21*a*, 21*b*, 21*c*, 21*d* in order to obtain the upright of FIG. 6*c*, whereas they are aligned with the holes 22*a*, 22*b*, 22*c*, 22*d* in order to obtain the upright of FIG. 6*b*.

Figure 8A:
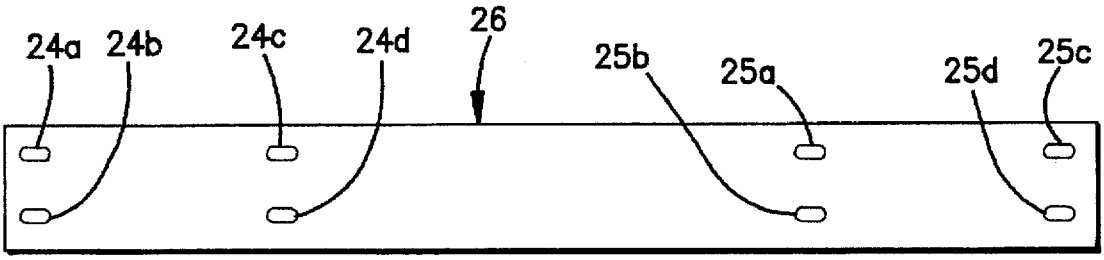
FIG. 8*a*, a connection plate between two uprights which are located apart from the junction point between two spans of the bridge.

Obviously, in the FIGS. 6*a*, 6*b*, 6*c*, the junction uprights 2 are shown on a reduced scale with respect to the standard upright 1 of FIGS. 5*a* and 5*b*, only for reasons of space but actually the uprights 1 and 2 always have the same dimensions and they are different only with respect to the above mentioned features. With reference to FIGS. 8*a* and 8*b*, there are shown a connection plate, between standard uprights 1 (FIG. 8*a*) which are located in a remote region with respect to the junction between two-spans of the bridge, and respectively, a connection plate between a standard upright 1 and a junction upright 2 (FIG. 8*b*).

With reference to FIG. 8*a*, the holes 24*a*, 24*b*, 24*c*, 24*d* of plate 26 are aligned with the holes 21*a*, 21*b*, 22*a*, 22*b* of a first standard upright 1, whereas the holes 25*a*, 25*b*, 25*c*, 25*d* of plate 26 are aligned with the holes 21*a*, 21*b*, 22*a*, 22*b*, of a second standard upright 1. Four plates 26 converge towards each upright, two from each of the contiguous uprights, the plates being superimposed along the whole width of the upright. Afterwards, fixing means are introduced in said holes, allowing the rigid connection of two subsequent standard uprights 1 of the light guardrail for bridges.

Figure 3:
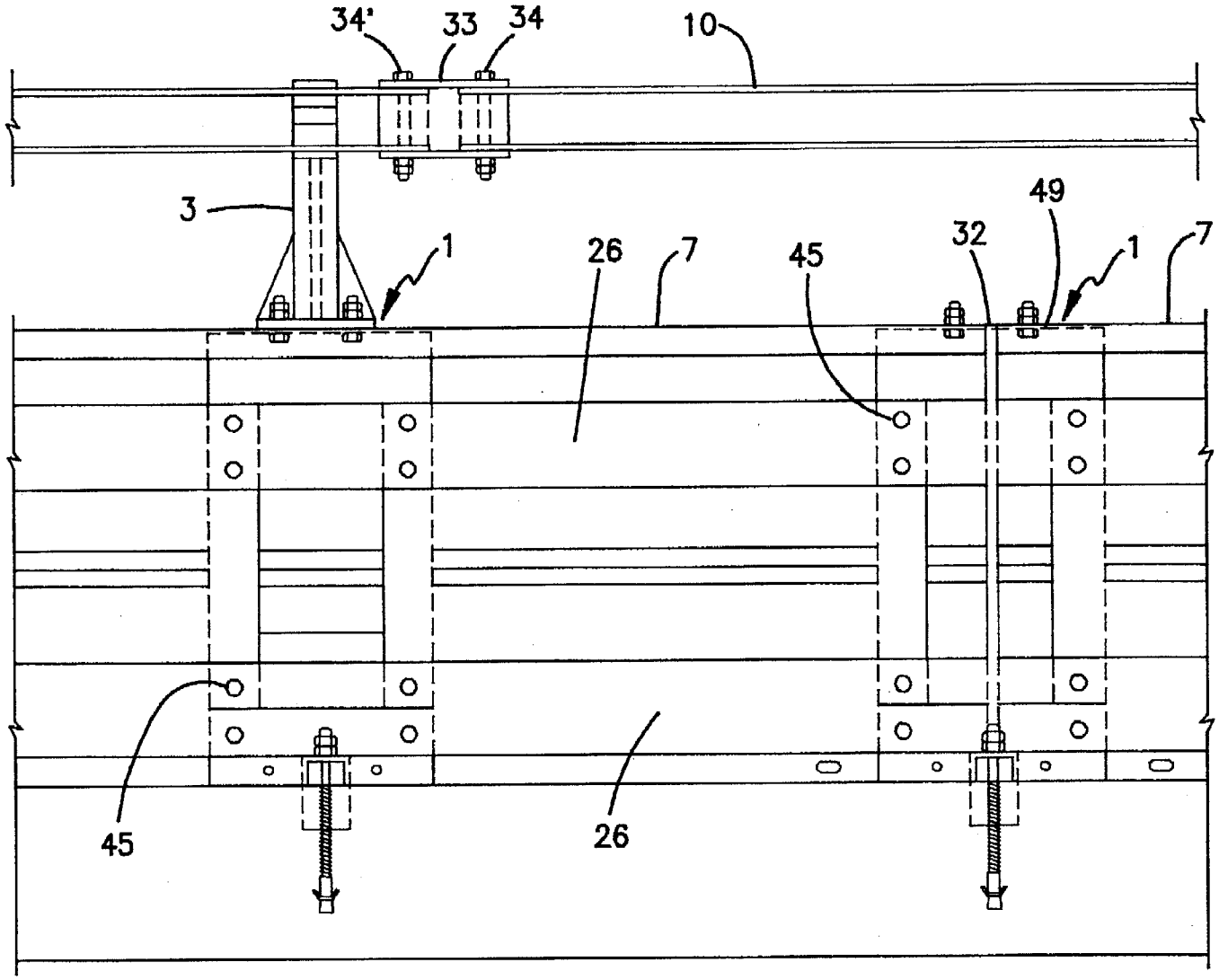
FIG. 3, a rear view of a segment of the New Jersey guardrail, according to the present inventions.

Furthermore, the holes 21*c*, 21*d*, 22*c*, 22*d* of the first standard upright 1 are aligned with the holes 24*a*, 24*b*, 4*c*, 24*d* of a second plate 26, and the holes 25*a*, 25*b*, 5*c*, 25*d* of said second plate are aligned with the holes 21*c*, 21*d*, 22*c*, 22*d* of the second upright, whereafter the second plate 26 is fixed to both standard uprights 1. In this way, the standard uprights 1 are connected in couples by means of two plates 26, as shown in FIG. 3. The plate 27 is used as shown in FIG. 4, in order to connect the two standard uprights 1 most near to the junction 28 between two spans of a bridge, to two junction uprights 2 (in FIG. 4, the standard upright 1 on the right is not shown for reasons of space).

Figure 4:
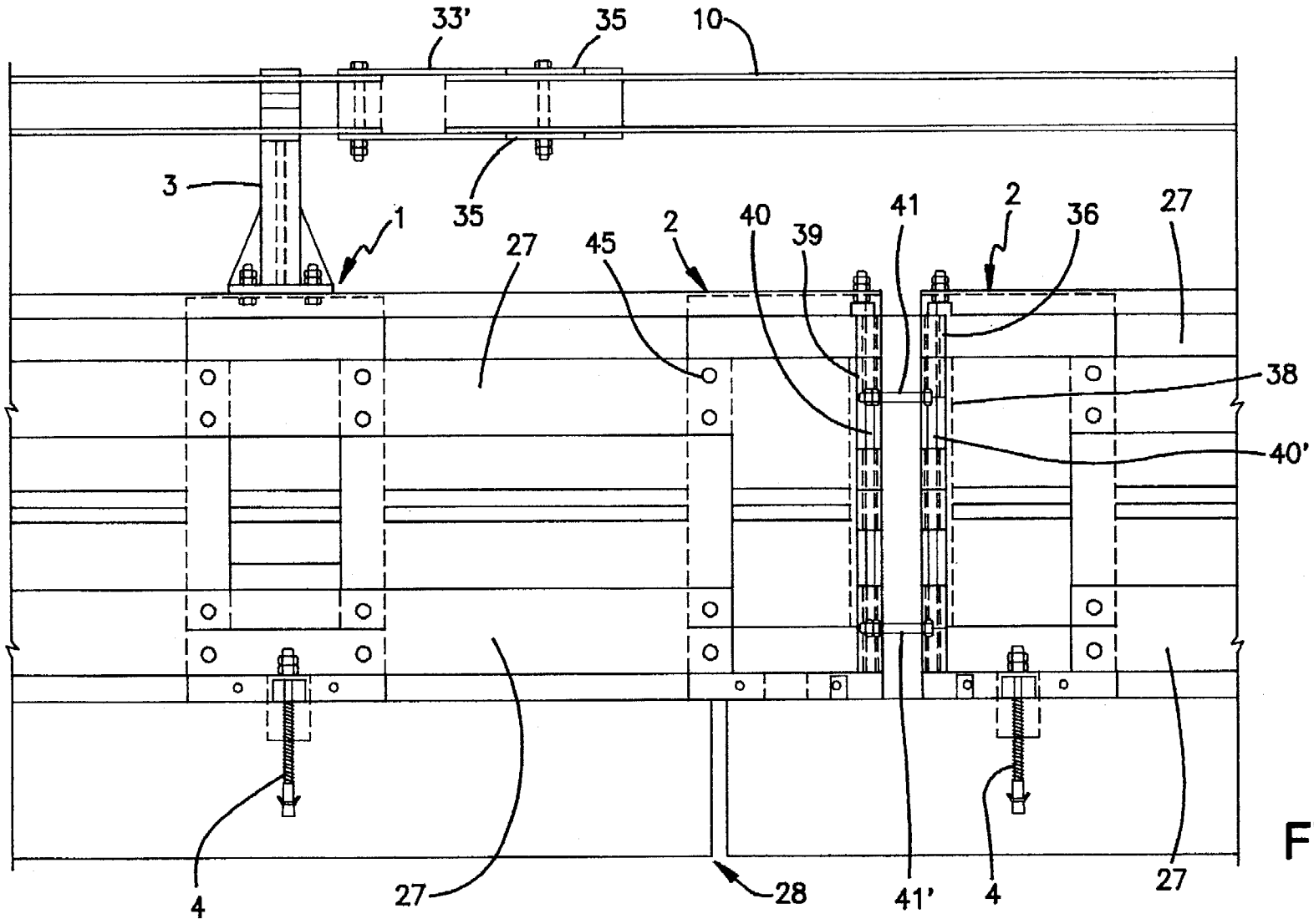
FIG. 4, a rear view of a segment of the New Jersey guardrail, according to the present invention, at the junction point between two spans of a bridge.

In order to connect the standard upright 1 in FIG. 4 to the junction upright 2, the holes 28*a*, 28*b*, 28*c*, 28*d* of plate 27 are aligned to the holes 21*a*, 21*b*, 22*a*, 22*b* of the standard upright 1 of FIG. 5*b*, whereas the holes 29*a*, 29*b* are aligned with the holes 30*a*, 30*b* of the junction upright 2 shown in FIG. 6*c*. Furthermore, a second plate 27 is used for this connection, and the holes 28*a*, 28*b*, 28*c*, 28*d* of this second plate 27 are aligned with the holes 21*c*, 21*d*, 22*c*, 22*d* whereas the holes 29*a*, 29*b* are aligned with the holes 31*a*, 31*b* of the upright 2 of FIG. 6*c*. Appropriate fixing means are then introduced into said holes.

Analogously, two plates 27 may be used for the connection between the junction upright 2 on the right in FIG. 4, and a standard upright 1 (a subsequent one) of the guardrail, not shown in FIG. 4 for reasons of space.

In regions which are remote from the junction 28, standard uprights 1 are used, as has been mentioned above.

FIG. 3 shows how the individual cover sheet steel elements 7 are placed adjacent to each other, and how they join at the junction points 32 which are located approximately every 6 metres along the guardrail (length of each cover sheet steal 7); thus, five uprights 1 are covered (the distance between centers thereof being 1,5 m), and the uprights at the ends are only half-covered along their width and the plate 49 placed above these uprights connects together the two contiguous cover sheet steel elements and the underlying upright.

As can be seen in FIG. 3, the handrail tube 10 is made up by several parts which are joined to each other by means of sleeves 33 and bolts 34, 34'.

At the site of a junction 28 between two spans of a bridge (see FIG. 4), it is necessary to use the junction uprights 2, which allow a non-rigid connection and therefore allow the longitudinal displacement of the guardrail at the site of the junction, due to temperature variations.

In the following, it will be described how this displacement is made possible.

First of all, the sleeve 33' of FIG. 4 has slots 35, 35' which allow the displacement, due to temperature variations, of the handrail tube 4 inserted into the sleeve 33'.

As can be seen in FIG. 4, only one of the junction uprights 2 is fixed to the kerbstone 5 by means of an anchor means 4.

Figure 7B:
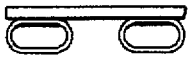
FIG. 7*b*, a cross sectional view taken along line A—A, of the plate of FIG. 7*a;*
Figure 7A:
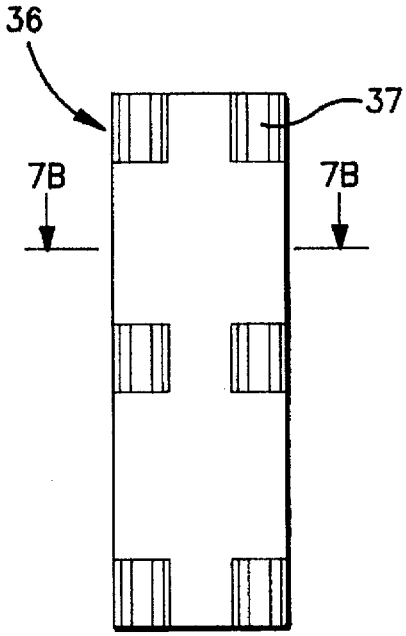
FIG. 7*a*, a connection plate between the uprights of FIGS. 6*b* and 6*c;*

The two junction uprights 2, 2' of FIG. 4 are connected to each other in the following manner the junction plate 36 shown in FIG. 7*a* has oval tubes 37 (see FIG. 7*b* which shows the cross-section along line A—A), and it is mounted on the uprights 2 of FIG. 4, in such a way that the oval tubes 37 are aligned and superimposed to the corresponding oval tubes 38, 39 of the junction uprights 2 shown in FIGS. 6*c* and 6*b*. Two rods 40, 40' respectively, are introduced in the two rows of oval tubes in order to obtain a hinge connection.

In this way it is assured that the upright 2 on the left may move (within certain limits) in a longitudinal direction with respect to the uprights 2 on the right side. The two slack bolts 41, 41' pass through the holes 17, 17' (FIG. 6*a*) and determine the maximum distance allowed between the two junction uprights 2 of FIG. 4. On the rear side, the guardrail has also covering panels 42 (see FIG. 1) which are mounted by means of screws 43, and which serve only in order to improve the guardrail under an aesthetical point of view, hiding the connection plates 26, 27 and their fixing means 45.

As may be seen in FIG. 1, part of the profile of the cover sheet steel 7, projects over the rear side of the upright 1, as indicated by the numeral 44, and the panel 42 is connected to this projecting part provided with holes for that purposes the lower part of this panel rests on appropriate supports 48 (for standard uprights 1) or 48' (for junction uprights 2). Referring always to FIG. 1, it can be seen that the kerbstone 5 has a hole 47 of 100 mm in diameter (expansion chamber), and when a vehicle collides with the guardrail, the anchor means 4 may get deformed, causing the moving backward of the guardrail, by occupying the cavity or hole 47, and allowing a moving backward of the upright 1 or 2, absorbing a considerable part of the collision energy, and decreasing in this way the decelerations of the colliding vehicle and its passengers.

We claim:

1. Light guardrail for bridges comprising a plurality of independent uprights (1, 2) made by a sheet steel and individually fixed by means of ductile anchor means (4) to a kerbstone of a bridge or other support (5), said uprights (1,2) being covered on a front side of the guardrail facing a road-bed, by a plurality of independent cover sheet steel elements (7) having a New Jersey profile, said cover sheet steel elements (7) being suited to adapt themselves to the profile of the uprights and being fixed (6,8) to the uprights, characterized in that at least a reinforcement rib (9) is provided on the cover elements (7), the guardrail being further characterized in that the uprights (1, 2) are connected to each other by rigid connection means, fixed on a rear side of respective uprights by means of fixing means (45), some of said uprights (1, 2) serving also as supports for a post (3) supporting a handrail, said post being fixed by means of bolts (6) to an upper part of a respective upright (1, 2) of the guardrail.

2. Light guardrail for bridges, according to claim 1, characterized in that the uprights (1, 2) have a shape like a box (15), with two lateral walls (11, 11'), an upper wall for fastening the cover sheet steel elements (7) and the post (3) for supporting the handrail, and portions (12, 12', 12") provided with holes (21*a*, 21*b*, 21*c*, 21*d*, 22*a*, 22*b*, 22*c*, 22*d*) for fixing steel plates (26, 27), whereby said uprights displace themselves under the direct collision force or the force transmitted by longitudinal ribs.

3. Light guardrail for bridges according to claim 2, characterized in that it comprises standard uprights (1) and junction uprights (2), the standard uprights (1) being fixed to the kerbstone (5) of the bridge in a region remote from a junction between two spans of the bridge and being connected together by means of a plate (26), whereas the invention uprights (2) are located in the region of a junction (28) and at least one of them is free to move without being fixed to the kerbstone (5), said junction uprights (2) being connected together through distance variation means (20, 36, 37, 38, 39, 40, 40', 41, 41') which allow a variation of the reciprocal distance within predetermined limits of the two junction uprights (2), said variation being due to changes of temperature.

4. Light guardrail for bridges, according to claim 3, characterized in that said distance variation means (20, 36, 37, 38, 39, 40, 60', 41, 41') comprise plates (20) having oval tubes (38, 39) and a counterplate (36) with oval tubes (37), and rods (40, 40') inserted in said oval tubes (37, 38, 39), the reciprocal maximum distance between two junction uprights (2), being limited by two slack bolts (41, 41') which pass through holes (17, 17') on the lateral walls (11).

5. Light guardrail according to claim 1, characterized in that the handrail (10) which is inserted in the upper part of the posts (3) supporting the handrail, is made up by several parts connected to each other by first sleeves (33), second sleeves (33') and bolts (34,34'), the second sleeves (33') being provided with slots (35, 35') and being located in the region of a junction (28).

6. Light guardrail for bridges according to claim 1, characterized in that said ductile anchor means (4) are embodied by screw anchors (4), and that the support or kerbstone (5) to which the upright (1, 2) is anchored, has a cavity (47) which allows the deformation of the screw anchor (4) and the moving backward of the upright (1, 2).

* * * * *